US008969725B2

(12) United States Patent
Mayer

(10) Patent No.: US 8,969,725 B2
(45) Date of Patent: Mar. 3, 2015

(54) SHIELDED CABLE

(75) Inventor: Oswald Mayer, Waldkraiburg (DE)

(73) Assignee: MD Elektronik GmbH, Waldkraiburg (DE)

( * ) Notice: Subject to any disclaimer, the term of this patent is extended or adjusted under 35 U.S.C. 154(b) by 288 days.

(21) Appl. No.: 13/467,494

(22) Filed: May 9, 2012

(65) Prior Publication Data

US 2012/0285715 A1 Nov. 15, 2012

(30) Foreign Application Priority Data

May 11, 2011 (EP) ..... 11003845

(51) Int. Cl.

| | |
|---|---|
| ***H01R 4/00*** | (2006.01) |
| ***H01R 9/03*** | (2006.01) |
| ***H01R 43/058*** | (2006.01) |
| *H01R 9/05* | (2006.01) |

(52) U.S. Cl.

CPC ..... *H01R 9/032* (2013.01); *H01R 43/058* (2013.01); *H01R 9/0518* (2013.01)

USPC ..... 174/74 R; 174/84 R; 174/88 C; 174/84 C

(58) Field of Classification Search

CPC ..... H01B 1/00–1/20; H01B 3/00; H01B 5/00; H01B 7/00; H01B 11/00; H01B 12/00; H01B 15/00; H01B 17/00; H01B 19/00; H01R 3/00; H01R 4/00; H01R 9/00; H01R 11/00; H01R 12/00; H01R 13/00; H01R 23/00; H01R 24/00; H01R 25/00; H01R 27/00; H01R 29/00; H01R 31/00; H01R 33/00; H01R 35/00; H01R 39/00; H01R 41/00; H01R 43/00

USPC ..... 174/74 R, 77 R, 78, 79, 84 R, 88 R, 88 C, 174/94 R, 84 C

See application file for complete search history.

(56) References Cited

U.S. PATENT DOCUMENTS

| | | | | | |
|---|---|---|---|---|---|
| 2,639,754 | A | | 5/1953 | Macy | |
| 3,141,924 | A | * | 7/1964 | Forney, Jr. | 174/75 C |
| 3,195,098 | A | * | 7/1965 | Miller et al. | 439/454 |
| 3,241,098 | A | | 3/1966 | Cobaugh et al. | |
| 4,941,850 | A | | 7/1990 | Ankers et al. | |
| 5,561,900 | A | * | 10/1996 | Hosler, Sr. | 29/828 |

(Continued)

FOREIGN PATENT DOCUMENTS

| | | | | | |
|---|---|---|---|---|---|
| DE | 198 48 343 | | 4/1999 | | |
| DE | 103 43 837 | | 6/2005 | | |
| DE | 10343837 | B3 * | 6/2005 | | H01R 4/18 |
| DE | 10 2007 047 436 | | 4/2009 | | |
| DE | 102007047436 | A1 * | 4/2009 | | H01R 4/18 |
| EP | 0 328 234 | | 8/1989 | | |
| EP | 1965465 | A2 * | 2/2008 | | H01R 9/08 |
| EP | 1 965 465 | | 9/2008 | | |

OTHER PUBLICATIONS

European Search Report, issued in corresponding European Patent Application No. 11003845.2.

*Primary Examiner* — William H Mayo, III

(74) *Attorney, Agent, or Firm* — Kenyon & Kenyon LLP

(57) ABSTRACT

A cable for transmitting HF signals includes a shield, at least one wire, and an electrically conductive sleeve. The sleeve includes a first and a second geometrical sleeve half as well as a first section and a second section. The sleeve is connected to the shield by crimping, such that the sleeve has at least one crimping ridge within the first section in the first sleeve half, and has no crimping ridges in the second sleeve half. It also has no crimping ridges within the second section in the first sleeve half and has at least one crimping ridge in the second sleeve half.

16 Claims, 5 Drawing Sheets

(56) References Cited

U.S. PATENT DOCUMENTS

| | | | | |
|---|---|---|---|---|
| 6,019,615 | A * | 2/2000 | Masuda | 439/99 |
| 6,080,018 | A * | 6/2000 | Ferrill et al. | 439/607.47 |
| 6,438,823 | B2 | 8/2002 | Yamakawa | |
| 6,568,075 | B1 | 5/2003 | Yamakawa | |
| 6,736,674 | B2 * | 5/2004 | Korte et al. | 439/578 |
| 6,835,096 | B2 * | 12/2004 | Togashi | 439/578 |
| 7,598,455 | B2 | 10/2009 | Gump et al. | |
| 2001/0002508 | A1 | 6/2001 | Yamakawa | |
| 2004/0018771 | A1 | 1/2004 | Togashi | |

* cited by examiner

Y - Y

Y -Y

X - X

SHIELDED CABLE

CROSS-REFERENCE TO RELATED APPLICATIONS

The present application claims priority to Application No. 11 003 845.2, filed in the European Patent Office on May 11, 2011, which is expressly incorporated herein in its entirety by reference thereto.

FIELD OF THE INVENTION

The present invention relates to a preassembled cable, which, for example, includes a plug connector for transmitting HF signals.

BACKGROUND INFORMATION

Such cables can be used in motor vehicles or aircrafts, for example, and are frequently required in large quantities. Simple construction and simple preassembly are important factors in the economic supply of corresponding cables. In addition, such cables must have excellent electromagnetic shielding in order to ensure that radiated electromagnetic waves do not cause problems in the onboard electronics of the vehicle. Furthermore, such cables must be produced such that they can be used to transmit signals having very high frequencies, as required for a high-quality video signal transmission, for example.

A cable with a shielded design is described in German Published Patent Application No. 10 2007 047 436. A crimp connection is provided such that it has a so-called center recess.

European Published Patent Application No. 0 328 234 describes a shielded cable, which features a crimp connection between a sleeve and a shield that is said to be suitable for high electromagnetic shielding.

SUMMARY

Example embodiments of the present invention provide a cable that has excellent shielding, so that the radiated electromagnetic output is minimized, that is to say, high EMC impermeability is ensured. Nevertheless, the cable should also be able to be manufactured at relatively low production cost.

According to example embodiments of the present invention, the cable for the transmission of HF signals includes a shield, at least one wire and an electrically conductive sleeve. The sleeve in turn has a longitudinal axis and, viewed geometrically, is subdividable into a first geometrical sleeve half and a second geometrical sleeve half, by a longitudinal cross-sectional plane. In addition, the sleeve has a first section and a second section, which are disposed at a mutual offset in the direction of the longitudinal axis. The sleeve also encloses the shield and is connected to the shield by a crimp connection. The crimping is provided such that the sleeve has at least one crimp ridge within the first section in the first sleeve half and does not have a ridge in the second sleeve half. At the same time, the sleeve is provided without crimp ridge within the second section in the first sleeve half and has at least one crimp ridge in the second sleeve half.

A sleeve half provided without crimp ridges in certain sections, for example, denotes that the particular axial section of the sleeve half has an uninterrupted concave configuration on the inside, so that uniform press-fitting of the shield takes place there such that it largely extends without geometrical interruptions. The mere existence of press-fitting marks on the outside of the sleeve thus cannot establish that the particular region of the sleeve is to be considered free of crimp ridges.

HF signals denote signals produced with the aid of high frequency technology, including also UHF or VHF signals, for example. Especially digital signals having a transmission rate that is greater than or equal to 10 MBit/s are also among them.

The sleeve may have a third section, which is located at an offset in relation to the first and second sections in the direction of the longitudinal axis. The sleeve has at least one crimp ridge within the third section in the first half, and does not have any crimp ridges in the second sleeve half.

The sleeve may have at least one crimp ridge within a first cross-section in the first sleeve half, and may have no crimp ridges in the second half, and the sleeve may be without crimp ridges within a second cross-section in the first sleeve half and may have at least one crimp ridge in the second sleeve half. The cross-sections have an orthogonal orientation in relation to the longitudinal axis and are disposed at a mutual offset in the direction of the longitudinal axis. If a third section is present, this, too, may be considered a third cross-section.

The axial length of a section results from the length of the crimp ridges, so that a section is as long as its longest crimp ridge. All crimp ridges in a section are usually of equal length. The sections may directly abut each other, so that a crimp ridge in one of the halves is always present across the entire crimp region.

The second section of the sleeve may have a smaller diameter than in the first section. In the event that the sleeve also includes a third section, the second section may have the smallest diameter in comparison with the first and third sections. The second section having the smallest diameter may be located between the first and the third section in the direction of the longitudinal axis.

The sleeve may have a peripherally closed configuration at least within the sections, i.e., in the crimping region. In other words, there is no opening or slot in the sleeve. As a result, the sleeve completely encloses the shield in the radial direction.

The at least one crimp ridge may have a greater axial extension in the first section than the at least one crimp ridge in the second section.

The crimp ridges may be set apart from each other about the longitudinal axis, at a center angle that is smaller than 150°, e.g., smaller than 135°. A center angle, for example, denotes a center point angle about a point on the longitudinal axis within the particular section in which the individual crimp ridges are provided.

Furthermore, the outside of the sleeve half without crimp ridges may have a continuous convex form in the second section. As an alternative or in addition, the outside of the sleeve half without crimp ridges may have a continuous convex form in the first section. In particular, the sleeve halves without crimp ridges may have a round design on the outside across a center angle of at least 180°.

The cable may have four wires which are twisted together. The cable may be configured according to a star quad arrangement, for example.

The cable may have an electrically conductive support clamp both in the first and second section, the shield resting against the support clamp radially inside and also radially outside. This bilateral contact may be achieved by folding the shield over prior to the crimping operation. The shield may include a multitude of individual wires so as to form a shield mesh, causing the individual wires to rest against the support clamp both radially inside and radially outside, or to be pressfitted with the support clamp. The sleeve halves without crimp ridges are arranged such that, for example, they have an inner contour that extends substantially parallel to the outer contour of the support clamp.

The crimp device for producing a cable includes two crimping indenters. Each of the two crimping indenters is equipped with a crimper and an anvil. The crimper and the anvil of both crimping indenters are disposed at a mutual offset relative to the longitudinal axis. In order to crimp the sleeves, the two crimping indenters are arranged such that they are able to engage with one another, to the effect that a crimper cooperates with an anvil when the crimping indenters are moved relative to each other toward the longitudinal axis of the sleeve.

The crimping device may be arranged such that at least one of the crimping indenters includes a saddle for the plastic deformation of the sleeve, its contour extending according to a reference line. A reference line denotes a line along a reference circle, e.g., along an open (not closed) circular line that extends across an angle of less than 360°.

In the simplest case, a crimping indenter includes exactly one crimper and one anvil. The crimping device may include two identical crimping indenters. The first crimping indenter may be disposed point-symmetrically in relation to the other crimping indenter, with respect to a point on the longitudinal axis of the sleeve. The two identical crimping indenters in the crimping device thus are able to be used rotated relative to one another about their normal axis. Furthermore, all crimpers of the crimping device and/or all anvils of the crimping device may have the same configuration.

The crimping device may include two crimping indenters, one of the crimping indenters having two crimpers and an anvil. As an alternative or in addition, one of the crimping indenters may have one crimper and two anvils. The crimper and anvil of a crimping indenter are arranged at a mutual offset in relation to the longitudinal axis and may engage with one another for crimping purposes or for the press-fitting of the sleeve.

One of the crimping indenters may be configured such that an anvil is disposed between two crimpers, or a crimper is disposed between two anvils. The crimping device may include a crimping indenter, in which an anvil is situated between two crimpers, and it includes a crimping indenter in which a crimper is situated between two anvils. The sequence of crimper-anvil along the longitudinal axis is such that a crimper is able to cooperate with an anvil in each case.

The crimping device may be configured such that at least one crimping indenter has a configuration in which anvil and crimper constitute different components or different crimping inserts, which are joined to each other in detachable manner, for example. At least one of the anvils or crimpers includes a saddle for the plastic deformation of the sleeve, the contour of which extends parallel to the longitudinal axis across the entire thickness of the component. The different components may have different thicknesses.

All components of the crimping device that are used as anvils may be implemented with the same contour as the saddle. In the same manner, all components of the crimping device that are used as crimpers may be implemented with the same contour as the saddle.

Example embodiments of the present invention make it possible to increase the conductivity of the crimping connection or to reduce the transition resistance, which results in a better shielding effect. The cables are therefore immune to external electromagnetic radiation and also emit virtually no such radiation. Furthermore, in the production of the cables, the crimping height is able to be adjusted very finely, so that high quality cables are able to be produced with a high degree of reproducibility.

Moreover, the crimping connection has extremely high tensile strength between the sleeve and shield.

Further features and aspects of example embodiments of the present invention are described in more detail below with reference to the appended Figures.

DETAILED DESCRIPTION

Figure 1:
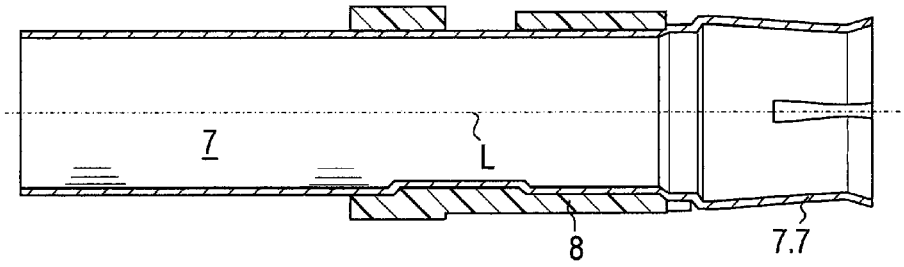
FIG. 1 is a cross-sectional view taken along a longitudinal cross-sectional plane through a sleeve for a shielded cable, prior to processing.

FIG. 1 shows a one-piece electrically conductive sleeve 7, which is produced by a deep-drawing process and includes a coupling end 7.7, which is suitable for producing a mating connection together with an additional coupling part. Sleeve 7 has a substantially hollow-cylindrical configuration, especially in the particular region provided for later crimping. A longitudinal axis L, which in a first approximation represents an axis of symmetry, may be assigned to sleeve 7. As for the rest, sleeve 7 has no interruptions, at least in its hollow-cylindrical tubular region, that is to say, it has no slot extending across the entire length of sleeve 7. Sleeve 7 is provided with an adapter 8 made of plastic, which is situated on sleeve 7 and produced by extrusion coating. The mounting mandrels (not shown in greater detail in the figures) provide for a form-locked, correctly positioned seat between adapter 8 and sleeve 7.

Figure 2A:
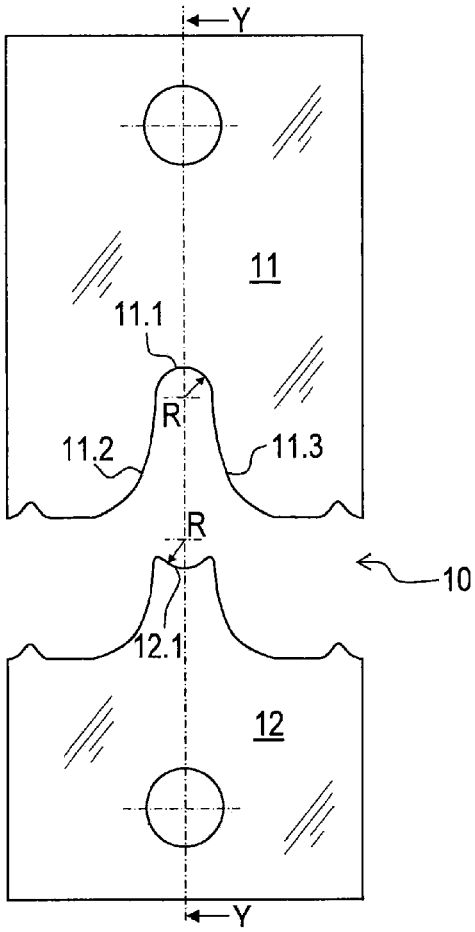
FIG. 2*a* is a plan view of a first crimp insert pair for producing the shielded cable.
Figure 2B:
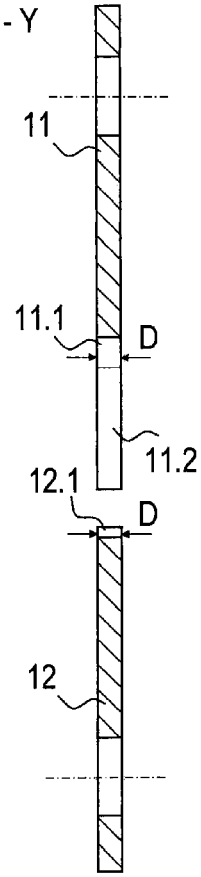
FIG. 2*b* is a cross-sectional view of the first crimp insert pair illustrated in FIG. 2*a*, taken along the line Y-Y shown in FIG. 2*a*.

A first crimp insert pair 10, which includes a crimper 11 and an anvil 12, is shown in FIGS. 2*a* and 2*b*. Crimper 11 and anvil 12 each have a saddle 11.1, 12.1, which is provided for the plastic deformation of sleeve 7. In the exemplary embodiment shown, saddles 11.1, 12.1 have a contour that takes the form of a graduated-circle line. Radius R of the contour, or the graduated-circle line, has identical dimensions for crimper 11 and anvil 12 in the region of saddle 11.1, 12.1. Crimper 11 also includes two flanks 11.2, 11.3, which are arranged opposite each other and serve as an infeed region for sleeve 7 to be crimped. As illustrated in FIG. 2*a*, in terms of the sum of the length of the contour of saddle 11.1 and flanks 11.2 and 11.3, crimper 11 thus has a longer concave contour than anvil 12, where substantially only the contour of saddle 12.1 is present as a concave contour. In the exemplary embodiment shown, crimper 11 and anvil 12 of first crimp insert pair 10 have a thickness D of, e.g., 2 mm.

Figure 3A:
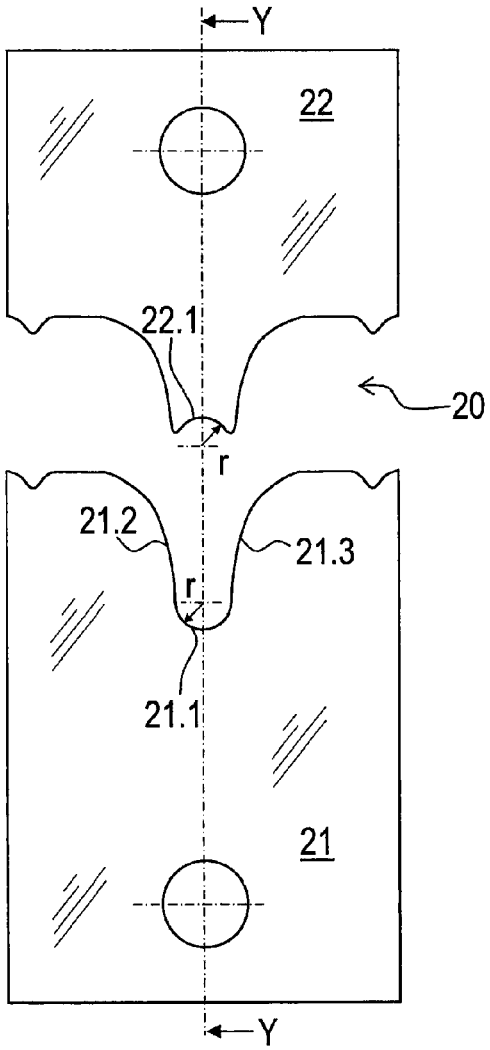
FIG. 3*a* is a plan view of a second crimp insert pair for producing the shielded cable.
Figure 3B:
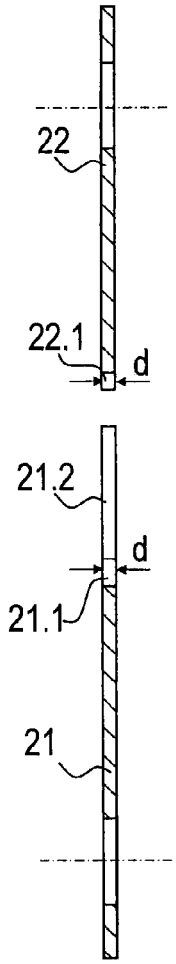
FIG. 3*b* is a cross-sectional view of the second crimp insert pair illustrated in FIG. 3*a*, taken along the line Y-Y shown in FIG. 3*a*.

FIGS. 3*a* and 3*b* show a second crimp insert pair 20. It also includes a crimper 21 and an anvil 22, each of which has a saddle 21.1, 22.1. In the region of saddle 21.1, 22.1, radius r of the contour has the same dimensions for crimper 21 and anvil 22. Crimp insert pair 20 differs from crimp insert pair 10 illustrated in FIGS. 2*a*, 2*b*, for example, in that radius r is slightly smaller than corresponding radius R in crimp insert pair 10. In contrast to crimp insert pair 10 illustrated in FIG. 2*b*, crimper 21 and anvil 22 illustrated in FIG. 3*b* have a thickness d of, e.g., only 1 mm. In terms of the sum of the length of the contour of saddle 21.1 and flanks 21.2 and 21.3, crimper 11 has a longer concave contour than anvil 22, where substantially only the contour of saddle 22.1 is provided as a concave contour.

Furthermore, a third crimp insert pair 30 (see FIG. 4*b*) may be used in the exemplary embodiment, which also includes a crimper and an anvil 32. The two crimp insert pairs 10, 30 have an identical configuration in the exemplary embodiment shown. Accordingly, the geometry of crimp insert 31 corresponds to the geometry of crimp insert 11 illustrated in FIGS. 2*a* and 2*b*, and the geometry of crimp insert 32 corresponds to the geometry of crimp insert 12 illustrated in FIGS. 2*a* and 2*b*.

Saddles 11.1, 12.1, 21.1, 22.1 of the six crimp inserts 11, 12, 21, 22, 31, 32 intended for the plastic deformation of sleeve 7 have a contour that extends parallel to longitudinal axis L across their entire thickness D, d. Accordingly, crimpers 11, 21, 31 and anvils 12, 22, 32 have no profile in the region of saddles 11.1, 12.1, 21.1, 22.1 in the direction of longitudinal axis L.

Figure 4A:
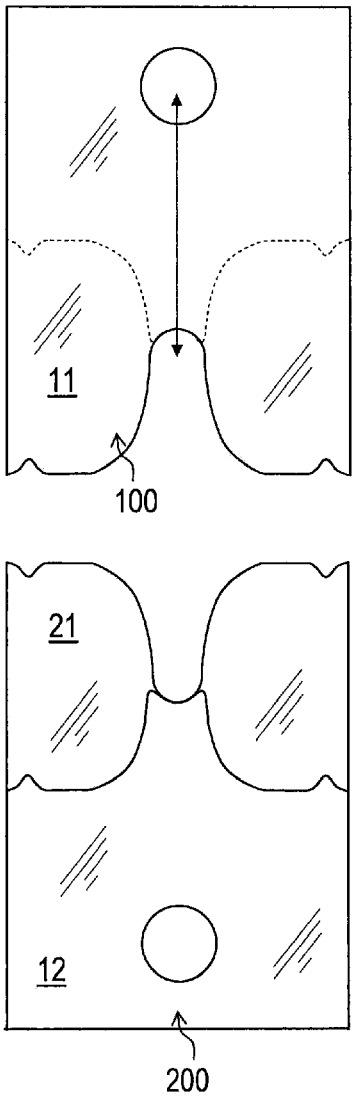
FIG. 4*a* is a plan view of a mounted crimping indenter for producing the shielded cable.
Figure 4B:
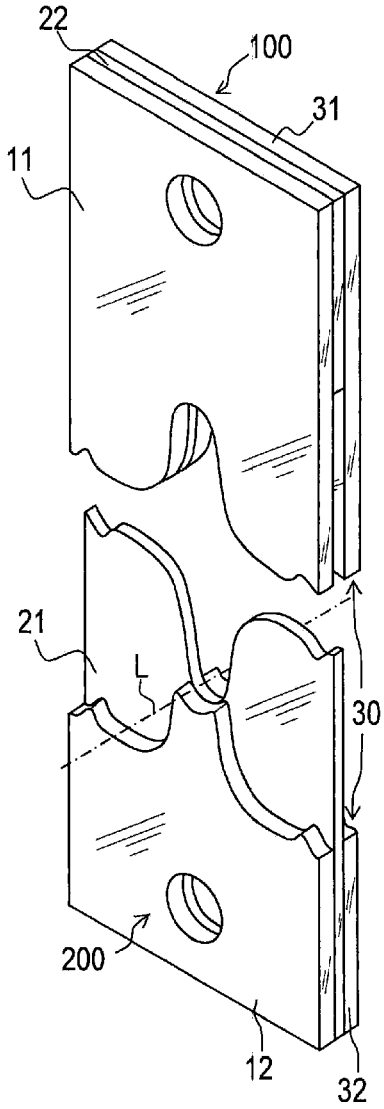
FIG. 4*b* is a perspective view of the mounted crimping indenter.
Figure 5:
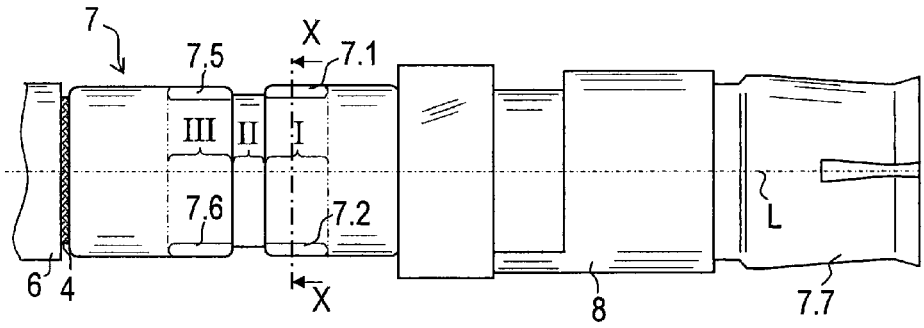
FIG. 5 is a lateral view of the end region of the cable.
Figure 6:
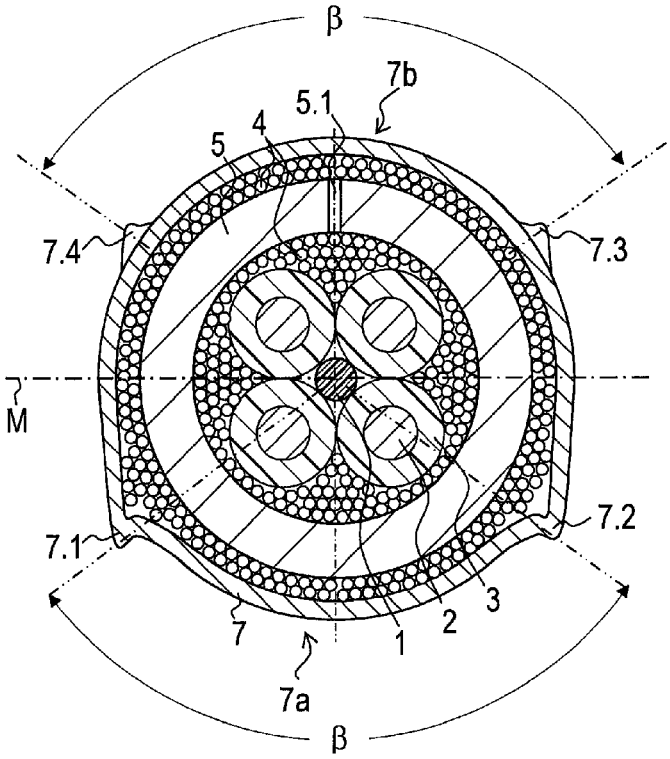
FIG. 6 is an enlarged cross-sectional view of the cable, taken along a cross-sectional plane X-X, shown in FIG. 5, through the cable.
Figure 7:
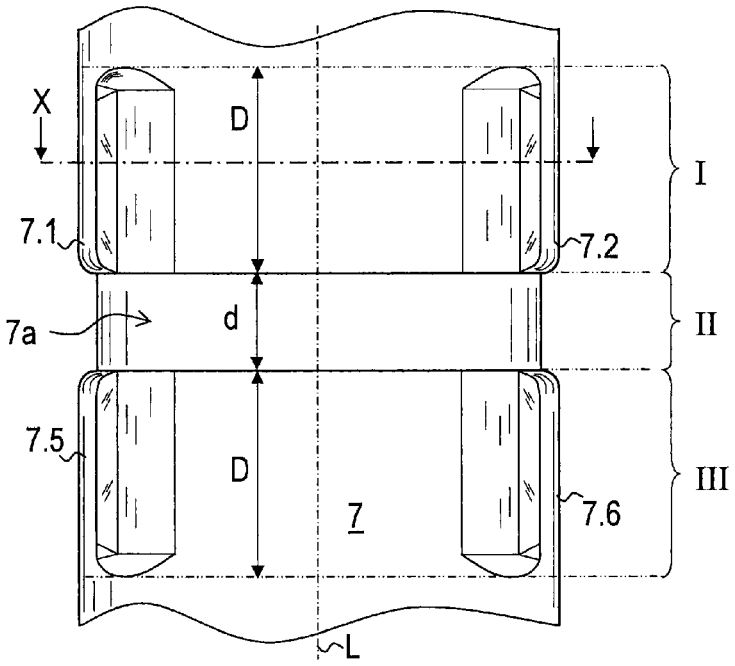
FIG. 7 is an enlarged detailed view of a sleeve half of the cable.
Figure 8:
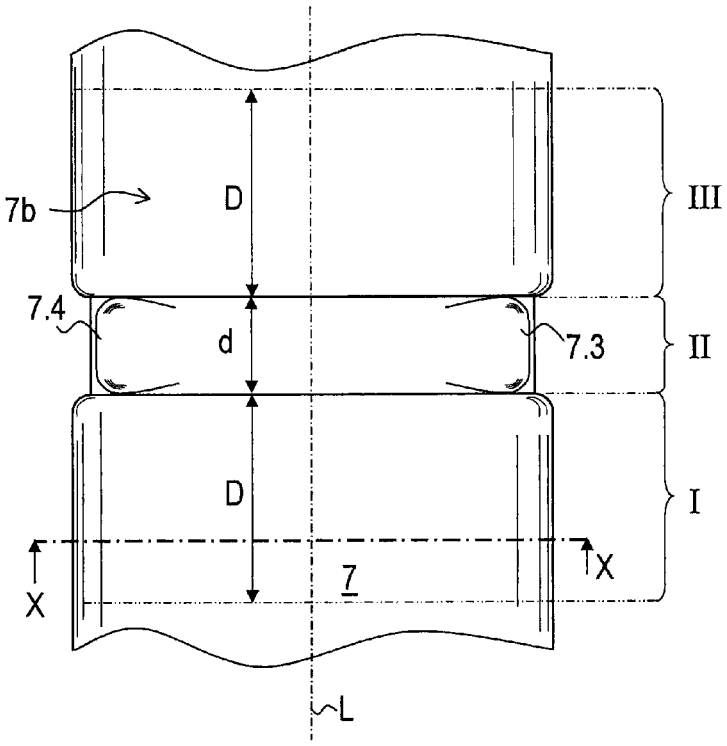
FIG. 8 is an enlarged detail view of the other sleeve half of the cable.

The three crimp insert pairs 10, 20, 30 are joined to form crimp indenters 100, 200, in the shape of a sandwich as illustrated in FIGS. 4*a* and 4*b*, so that crimpers 11, 21, 31 and anvils 12, 22, 32 are disposed at a mutual offset in relation to longitudinal axis L. First crimping indenter 100 includes crimpers 11 and 31 and anvil 22. In first crimping indenter 100, anvil 22 is situated between the two crimpers 11, 31. Second crimping indenter 200 is assigned anvils 12, 32 and crimper 21. For crimping indenter 200, crimper 21 is situated between the two anvils 12, 32.

A cable, as illustrated in FIGS. 5 to 8, is to be produced with the aid of crimping indenters 100, 200 shown in FIGS. 4*a* and 4*b*. In the center, the cable has a filler 1 formed of an insulating material, about which four wires 2 enclosed by insulation 3 are disposed in twisted manner. A shield 4, e.g., in the form of a shield mesh, is situated radially outside in relation to wires 2 provided with insulation 3. Shield 4 is enclosed by an insulating jacket 6 (see FIG. 5) over the majority of the cable length. Such cables are also frequently referred to as star quads. The four wires 2 including their insulations 3 are twisted together, which achieves high cross-talk damping.

In the course of the cable assembly, insulating jacket 6 is first removed in an end region of an electrical line, so that shield 4 is exposed in this end region. Next, an electrically conductive support clamp 5, which has a slot 5.1 (see FIG. 6), is press-fit around shield 4, and shield 4 is folded over around support clamp 5, e.g., inverted. Sleeve 7 is then slipped onto inverted shield 4. Such a sleeve 7 may also be referred to as outer conductor sleeve. In the region where crimping is to be performed, the outer diameter of sleeve 7 is slightly larger than double the radius R, r of saddles 11.1, 12.1, 21.1, 22.1.

A crimping process subsequently creates an electrical and mechanical connection between sleeve 7 and shield 4. For this purpose sleeve 7 situated on the cable is placed between crimping indenters 100, 200. Crimping indenter 100 illustrated in FIG. 4*b* is then moved in the direction of second crimping indenter 200, until the hollow-cylindrical part of sleeve 7 is press-fit against shield 4 to the desired extent.

In the region of sleeve 7, the cable produced in this manner has three circumferential sections I, II, III, which are disposed at an axial offset relative to the direction of longitudinal axis L of sleeve 7. The axial length of each section I, II, III results from thickness D, d of crimpers 11, 21, 31 or anvils 12, 22, 32 (see FIGS. 7 and 8). In the exemplary embodiment illustrated, sections I and III have an axial length of 2 mm, while center section II has an axial length of 1 mm. Sections I, II, III may thus be considered virtual disks in geometrical terms, which have thicknesses D and d and end faces that have an orthogonal orientation to longitudinal axis L.

It is possible to geometrically subdivide sleeve 7 into two sleeve halves 7*a*, 7*b*, a longitudinal section plane M, which is located in the center in relation to sleeve 7 in this case, geometrically separating the two sleeve halves 7*a*, 7*b*. Sleeve halves 7*a*, 7*b* thus are arranged in the approximate shape of tubular half-shells. Considered in geometrical terms, longitudinal axis L therefore is located on longitudinal section plane M, so that longitudinal section plane M thus simultaneously constitutes the drawing plane of FIG. 7 and FIG. 8.

In the assembled cable, sleeve 7 encloses shield 4, so that shield 4 is resting against support clamp 5 both on the radially inner side of support clamp 5 and on the radially outer side of support clamp 5.

Due to the slightly smaller radius r of saddles 22.1, 22.2 of second crimp insert pair 20, a constriction is produced in second section II, e.g., crimped sleeve 7 has a smaller diameter in second section II.

The crimping produces crimp ridges 7.1 to 7.6 in sleeve 7 as a result of the crimping operation, so that, within first and third axial sections I, III in first sleeve half 7*a*, sleeve 7 has two crimp ridges 7.1, 7.2; 7.5, 7.6 in first sleeve half 7*a*. In second sleeve half 7*b*, sleeve 7 is free of crimp ridges in first and third axial sections I, III, e.g., concave throughout on the inside, so that uniform press-fitting, largely without geometrical interruptions, of the shield takes place there. Furthermore, sleeve 7 is provided without crimp ridges within second section II in first sleeve half 7*a*, while it has two crimp ridges 7.3, 7.4 in second sleeve half 7*b*. In the exemplary embodiment shown, crimp ridges 7.1, 7.2 in first section I, crimp ridges 7.3, 7.4 in second section II, and crimp ridges 7.5, 7.6 in third section III are disposed about longitudinal axis L at a distance from each other, at a center angle β. In this case, the center angle β amounts to, e.g., 120°. A center angle denotes the central angle about a point on longitudinal axis L within the particular section I, II, III. It should be understood that the shortest distance is meant as relevant center angle and not, for example, the complementary angle (in this case, 240°) in relation to the 360° circumference. Sleeve half 7*a* has a convex shape throughout at its outer side in second section II. It has radius r there, while sleeve half 7*b* has a convex shape throughout at its outer side in first section I and third section III, these sections I, III having radius R. An excellent electrical connection is obtained between shield 4 and sleeve 7 due to the special arrangement of the crimping. In addition, increased mechanical tensile strength is provided as well.

The cable may be used in motor vehicles, for example, for the purpose of transmitting HF signals (high frequency signals). In particular, the cable may be used for establishing a so-called FAKRA (Fachkreis Automobil) mating connection. Adaptor 8 illustrated in FIGS. 1 and 5 may be used to affix a secondary locking mechanism in the correct position. Due to the high data transmission rates such as 480 MBit/s, high voltage frequencies on the order of magnitude of 40 MHz, for example, arise in the cable. A conventional cable may cause relatively high radiation levels. The high radiation levels may trigger interference in the onboard electronics of a vehicle, in particular, which must be avoided under all circumstances, especially in the case of safety-relevant functions of the onboard electronics. The configuration of the cable described herein may achieve extremely satisfactory EMC impermeability, so that radiation levels of the cable in the region of the mating connector or sleeve 7 are sharply reduced.

What is claimed is:

1. A cable for transmitting HF signals, comprising:

a shield;

at least one wire; and an electrically conductive sleeve having a longitudinal axis, and the sleeve being geometrically subdividable into a first geometrical sleeve half and a second geometrical sleeve half by a longitudinal cross-sectional plane;

wherein the sleeve includes a first section and a second section, the first section and the second section being disposed at a mutual offset in a direction of the longitudinal axis, the sleeve enclosing the shield and crimpedly connected to the shield;

wherein, within the first section, the sleeve includes at least one crimping ridge in the first sleeve half and no crimping ridges in the second sleeve half; and wherein, within the second section, the sleeve includes no crimping ridges in the first sleeve half and at least one crimping ridge in the second sleeve half.

2. The cable according to claim 1, wherein the sleeve includes a third section disposed at an offset in relation to the second section in the direction of the longitudinal axis, and the sleeve has at least one crimping ridge within the third section in the first sleeve half and has no crimping ridges in the second sleeve half.

3. The cable according to claim 1, wherein the sleeve has a smaller diameter in the second section than in the first section.

4. The cable according to claim 1, wherein the at least one crimping ridge has a greater axial length in the first section than the at least one crimping ridge in the second section.

5. The cable according to claim 1, wherein the crimping ridges are situated at a distance from each other about the longitudinal axis, at a center angle which is less than 150°.

6. The cable according to claim 5, wherein the crimping ridges are situated at a distance from each other about the longitudinal axis, at a center angle which is less than 135°.

7. The cable according to claim 1, wherein an outer side of the sleeve half without crimping ridges in the second section and/or an outer side of the sleeve half without crimping ridges in the first section are convex throughout.

8. The cable according to claim 1, wherein the cable includes four wires twisted together.

9. The cable according to claim 1, wherein the cable includes an electrically conductive support clamp both in the first section and the second section, the shield resting against the support clamp radially inside and radially outside.

10. A cable for transmitting HF signals, comprising:

a shield;

at least one wire; and an electrically conductive sleeve having a longitudinal axis and geometrically subdividable into a first geometrical sleeve half and a second geometrical sleeve half by a longitudinal sectional plane, the sleeve enclosing the shield and crimpedly connected to the sleeve;

wherein, within in a first cross-section, the sleeve includes at least one crimping ridge in the first sleeve half and no crimping ridges in the second sleeve half;

wherein, within a second cross-section, the sleeve includes no crimping ridges in the first sleeve half and at least one crimping ridge in the second sleeve half; and wherein the cross-sections are orthogonally oriented in relation to the longitudinal axis and are disposed at a mutual offset in a direction of the longitudinal axis.

11. The cable according to claim 10, wherein the sleeve includes a third cross-section disposed at an offset in relation to the second cross-section in the direction of the longitudinal axis, and within the third cross-section, the sleeve includes at least one crimping ridge in the first sleeve half and no crimping ridges in the second sleeve half.

12. The cable according to claim 10, wherein the second cross-section has a smaller diameter than the first cross-section.

13. The cable according to claim 10, wherein the crimping ridges are arranged at a distance from each other about the longitudinal axis, at a center angle which is less than 150°.

14. The cable according to claim 13, wherein the crimping ridges are arranged at a distance from each other about the longitudinal axis, at a center angle which is less than 135°.

15. The cable according to claim 10, wherein the cable includes four wires twisted together.

16. The cable according to claim 10, wherein the cable includes an electrically conductive support clamp both in the first cross-section and the second cross-section, the shield resting against the support clamp radially inside and radially outside.

* * * * *